US005953953A

United States Patent [19]

Allmann et al.

[11] Patent Number: 5,953,953

[45] Date of Patent: Sep. 21, 1999

[54] APPARATUS AND METHOD FOR DETECTING A SPLICE IN A RUNNING LENGTH OF WEB

[75] Inventors: Erwin L. Allmann, Penfield; Camiel J. Raes, Phelps, both of N.Y.

[73] Assignee: Eastman Kodak Company, Rochester, N.Y.

[21] Appl. No.: 08/951,775

[22] Filed: Oct. 16, 1997

[51] Int. Cl.[6] ..... G01L 5/10

[52] U.S. Cl. ..... 73/159

[58] Field of Search ..... 73/159

[56] References Cited

U.S. PATENT DOCUMENTS

| | | | |
|---|---|---|---|
| 3,854,643 | 12/1974 | Weaver | 226/35 |
| 4,194,659 | 3/1980 | Birch | 226/35 |
| 4,221,316 | 9/1980 | Jenkins et al. | 226/35 |
| 4,297,585 | 10/1981 | Puschmann | 250/560 |
| 4,314,757 | 2/1982 | Anderson et al. | 355/29 |
| 4,519,249 | 5/1985 | Hunt | 73/596 |
| 4,583,669 | 4/1986 | Sirkis | 226/35 |
| 4,630,120 | 12/1986 | Childs | 358/214 |
| 4,639,152 | 1/1987 | Yamamoto et al. | 400/120 |
| 4,652,329 | 3/1987 | Focke | 156/351 |
| 4,901,577 | 2/1990 | Roberts | 73/600 |
| 5,045,134 | 9/1991 | Schenker et al. | 156/64 |
| 5,235,515 | 8/1993 | Ungpiyakul et al. | 364/469 |
| 5,243,408 | 9/1993 | Whitham . | |
| 5,253,819 | 10/1993 | Butler, Jr. | 242/58.3 |
| 5,271,284 | 12/1993 | Still et al. | 73/865.8 |
| 5,277,731 | 1/1994 | Krimsky et al. | 156/159 |
| 5,286,543 | 2/1994 | Ungpiyakul et al. | 428/74 |

FOREIGN PATENT DOCUMENTS

| | | |
|---|---|---|
| 629277 | 9/1949 | United Kingdom . |
| 1160545 | 9/1969 | United Kingdom . |
| 1333160 | 10/1973 | United Kingdom . |
| EP 609172 | 9/1994 | United Kingdom . |

*Primary Examiner*—Ronald Biegel
*Assistant Examiner*—Willie Morris Worth
*Attorney, Agent, or Firm*—Susan L. Parulski

[57] ABSTRACT

Apparatus and method for detecting the presence of a splice in a running length of web material, particularly photosensitive web material. The apparatus includes first and second encoders coupled to first and second rollers, respectively. As the web material is transported across the rollers, the speeds of the rollers are continuously and simultaneously detected. The rollers will travel at substantially the same speed when the web is being transported across both rollers. The presence of the splice is detected when the speeds of the two rollers differ.

8 Claims, 5 Drawing Sheets

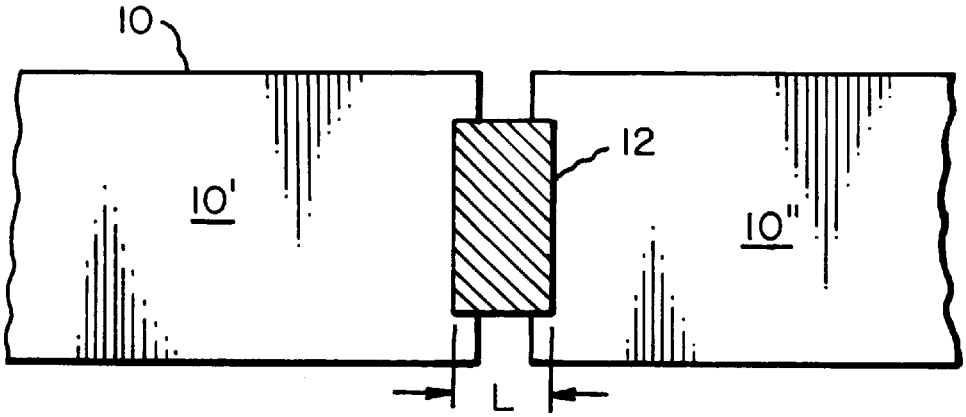
FIG. 1
FIG. 3(a)
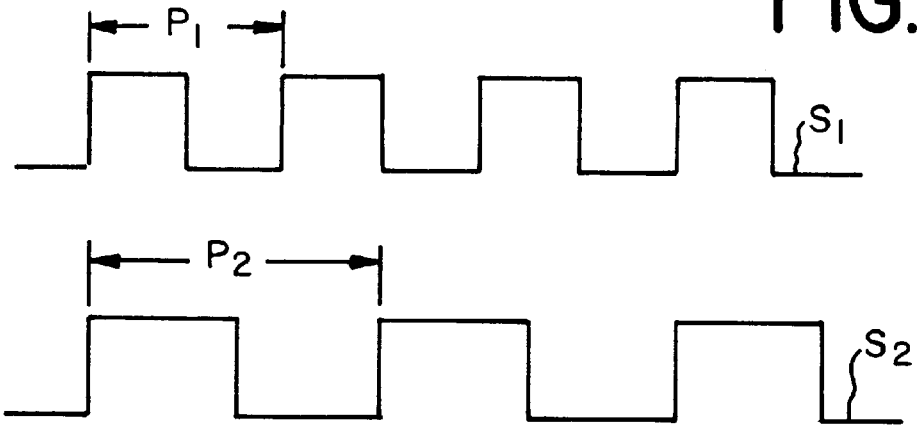
FIG. 3(b)
FIG. 8
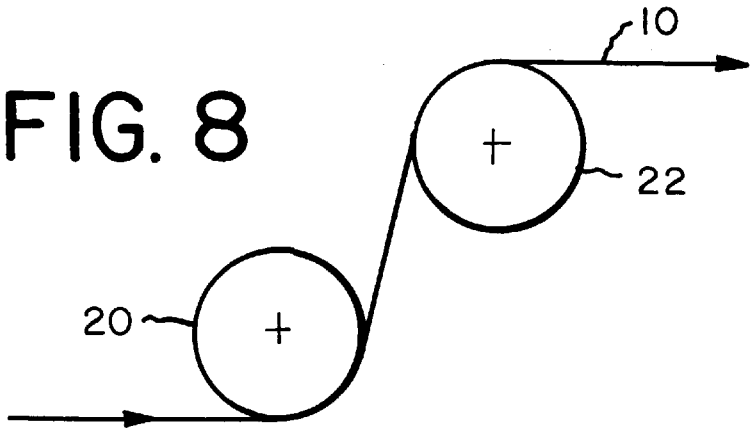

APPARATUS AND METHOD FOR DETECTING A SPLICE IN A RUNNING LENGTH OF WEB

FIELD OF THE INVENTION

The present invention relates to the transport of web material. More particularly, the present invention relates to an apparatus and method for detecting a splice in a length of web material being transported along a web path.

BACKGROUND OF THE INVENTION

When a web material is continuously fed from a plurality of successive rolls, the ends of the rolls may be spliced together to eliminate interruption to the web feed. Different types of splices can be formed, including a lap splice, a butt splice, and a gap splice. A lap splice is formed when a portion of an expiring web overlies a portion of a web from a new roll with the under surface of the overlapped portion of one of the webs adhering to the upper surface of the other web. With a butt splice, the trailing end of the expiring web is in intimate contact with the leading end of the new web, but no overlap exists. A gap splice is formed when no overlap exists and the ends of the expiring web and new web are separated. For the butt splice and the gap splice, tape may be employed to connect the ends. U.S. Pat. No. 5,277,731 relates to the formation of a butt splice. U.S. Pat. No. 4,652,329 and U.S. Pat. No. 5,045,134 teach apparatus and methods for forming a splice.

The location of the splice may need to be detected if further processing of the web material is to be conducted. For example, if the web material is photographic paper, the location of the splice needs to be detected so that a printer does not record a photographic image on the portion of the photographic paper containing the splice. In the manufacturing process, the location/presence of a splice needs to be detected before cutting and slitting operations can occur.

Mechanical sensors or other contact devices may be employed. One method used to detect a splice is to mechanically monitor the difference in thickness of the web, signifying the passage of a splice. U.S. Pat. No. 3,854,643 relates to an apparatus for detecting a splice wherein an increased thickness of a splice imparts a slight movement in a pressure roller to indicate the presence of a splice. U.S. Pat. No. 4,314,757 relates to a splice detector for photographic paper wherein a splice warning slot in the paper activates a switch. U.S. Pat. No. 4,194,659 provides an example of an electromechanical seam detector for the textile industry. While such apparatus may be suited for their intended purpose, such mechanical and contact sensors require a lengthy set-up procedure, do not provide for variations in web thickness, are not suitable for fast moving webs, may induce scratches on the web, or generate static.

Optical sensors may be employed. However, such optical sensors are unsuitable for photosensitive web material. Ultrasonics have also been employed, but typically involved complicated circuitry and set-up procedures. U.S. Pat. No. 4,901,577 provides an example of an apparatus for detecting a splice using ultrasonics.

Accordingly, there exists a need for an apparatus and method for detecting a splice in a running length of web material. Such an apparatus and method should have a quick set-up procedure, operate for webs traveling at a high rate of speed, provide for variations in web thickness, not induce scratches in the web material, not generate static, and be suitable for photosensitive web material.

SUMMARY OF THE INVENTION

An object of the invention is to provide an apparatus and method for detecting a splice in a moving web.

Another object of the invention is to provide such an apparatus and method which is suitable for photosensitive web material.

Yet another object of the invention is to provide such an apparatus and method which does not require a lengthy set-up procedure.

A further object of the invention is to provide such an apparatus and method which provides for variations in web thickness.

A still further object of the invention is to provide such an apparatus and method which does not cause scratches or other defects to the web.

These objects are given only by way of illustrative example. Thus, other desirable objectives and advantages inherently achieved by the disclosed invention may occur or become apparent to those skilled in the art. The invention is defined by the appended claims.

According to one aspect of the invention, there is provided an apparatus for detecting the presence of a splice in a running length of web material. The apparatus includes a first encoder coupled to a first roller and a second encoder coupled to a second roller. The web material is transported across the first and second rollers, with the first and second encoder simultaneously detecting a first and second speed of the web material. A comparitor compares a difference between the first and second speeds and provides a signal indicative of the presence of the splice when the magnitude of the difference is greater than a predetermined value.

According to another aspect of the invention, there is provided a method for detecting a presence of a splice in a running length of web material. The web material is transported across a first roller coupled to a first encoder and a second roller coupled to a second encoder. Simultaneously, a speed of the first and second rollers are determined. The difference of the two speeds are compared, and the presence of the splice is detected when the magnitude of the difference is greater than a predetermined value.

The present invention provides an apparatus and method for detecting a splice in a moving web. It allows for a quick set-up procedure, provides for variations in web thickness, does not induce scratches or other aberrations in the web material, does not generate static, and is suitable for photosensitive web material.

BRIEF DESCRIPTION OF THE DRAWINGS

The foregoing and other objects, features, and advantages of the invention will be apparent from the following more particular description of the preferred embodiments of the invention, as illustrated in the accompanying drawings.

FIG. 1 shows a length of web material spliced together by a splice.

FIGS. 3(*a*) and 3(*b*) show signals provided from encoders coupled to first and second rollers.

FIG. 8 shows an alternate arrangement of the first and second rollers.

DETAILED DESCRIPTION OF THE INVENTION

Figure 2:
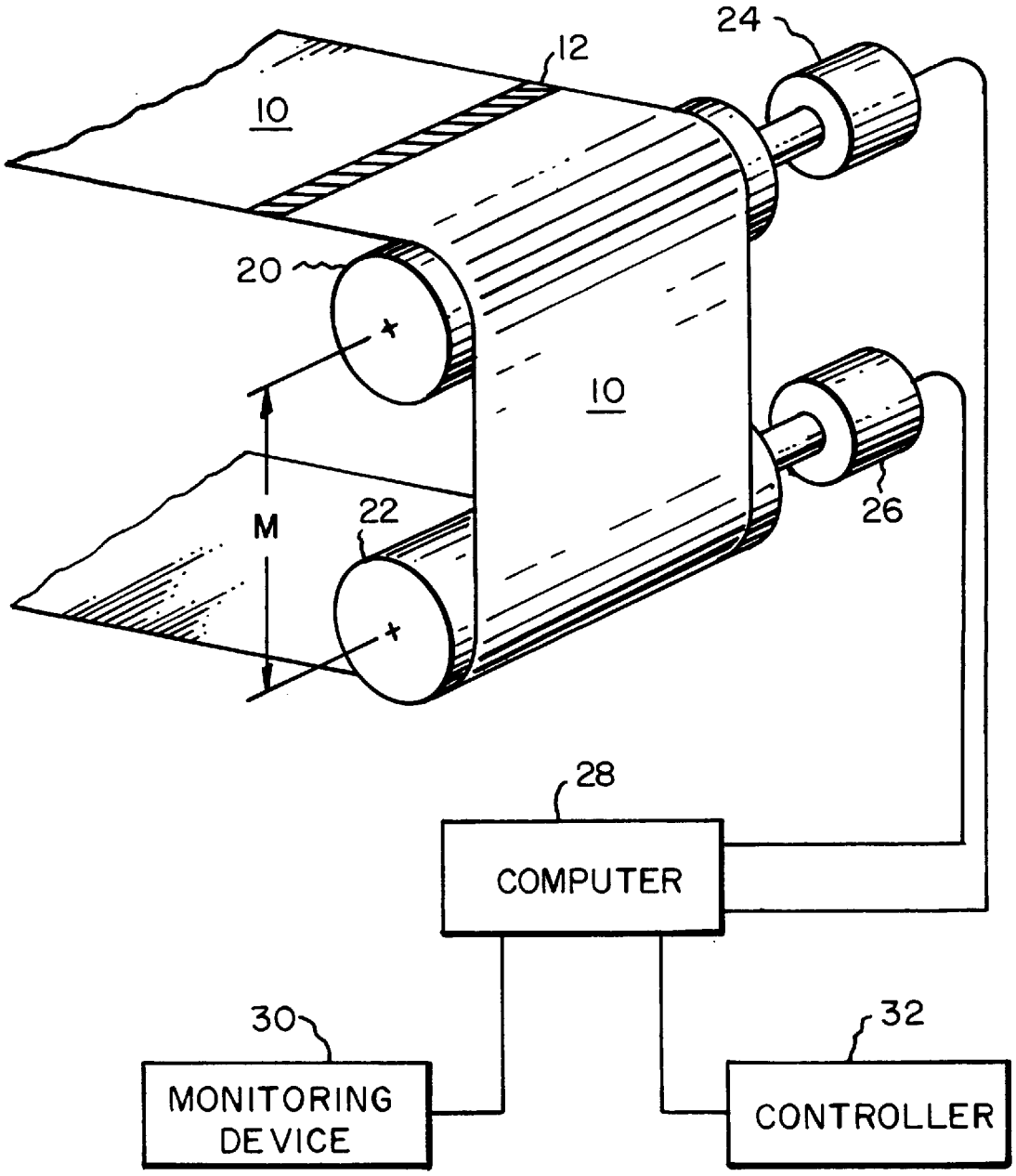
FIG. 2 shows an embodiment of the apparatus in accordance with the present invention.

The following is a detailed description of the preferred embodiments of the invention, reference being made to the drawings in which the same reference numerals identify the same elements of structure in each of the several figures.

FIGS. 1 and 2 generally illustrate a length of web material 10, comprised of an expiring length 10' and a new length 10", spliced together by a splice 12 having a length L. Splice 12 can be any type of splice, for example, a lap splice, a butt splice, or a gap splice. FIG. 1 illustrates splice 12 as a gap splice. Splice 12 generally has a thickness which differs from the thickness of web material 10. For example, for a gap splice, tape employed to form the splice may have a thickness thinner or thicker than the web. Similarly, for a butt splice, tape employed to form the splice would cause the splice to be thicker than the web material. For a lap splice, an overlapping portion of web material would cause the splice to be thicker than the web material.

FIG. 2 generally illustrates an apparatus in accordance with the present invention for detecting the presence of splice 12 as web material 10 is being transported across a first roller 20 and a second roller 22. First and second rollers 20, 22 rotate about axes which are substantially parallel and are in spaced relation by a distance M, which can be greater or less than length L of splice 12. A first encoder 24 is coupled to first roller 20, and a second encoder 26 is coupled to second roller 22.

As web material 10 is transported across first and second rollers 20, 22, first and second encoders 24, 26 continuously and simultaneously provide signals $S_1$, $S_2$, respectively, to a microprocessor or computer 28. Signals $S_1$, $S_2$, shown in FIGS. 3(*a*) and 3(*b*), have a period of $P_1$, $P_2$, respectively, which is manipulated by computer 28 to represent a speed $V_1$, $V_2$, of first and second rollers 20, 22, respectively. Computer 28 or other comparitor can determine a difference between speed values V1, V2. Alternatively, the speed values $V_1$, $V_2$ can be represented by computer 28 as a speed ratio R. Accordingly, if rollers 20, 22 are traveling at the same speed, speed ratio R is equal to 1.0. The speed difference or speed ratio R can be visually observed by an oscilloscope or other monitoring device 30. Further, a controller 32 can control the transport process of the web material dependent on the information sent to computer 28.

When web material 10 is transported across a roller (either first roller 20 or second roller 22), a first speed A is detected by the corresponding encoder. When splice 12 is transported across a roller (either first roller 20 or second roller 22), a second speed B, different than first speed A, is detected by the corresponding encoder. That is, since the thickness of splice 12 differs from the thickness of web material 10, the speed of the roller differs as splice 12 is transported across the roller as compared to when web material 10 is transported across the roller. For example, if splice 12 is thicker than web material 10, the speed of the roller would decrease as splice 12 is transported across the roller, as compared to when web material 10 is transported across the same roller. Similarly, if splice 12 is thinner than web material 10, the speed of the roller would increase as splice 12 is transported across the roller, as compared to when web material 10 is transported across the same roller. Accordingly, the presence of the splice is detected by a change in speed of the rollers. The change in speeds can be determined by comparing the magnitudes of the difference or through speed ratio R.

For example, referring again to FIG. 2, web material 10 is transported across first roller 20 and second roller 22. Splice 12 is not disposed across either first roller 20 or second roller 22. As such, simultaneously determined speed values $V_1$, $V_2$ are substantially the same, therefore, there is no speed difference and speed ratio R is approximately equal to 1.0.

Figure 4:
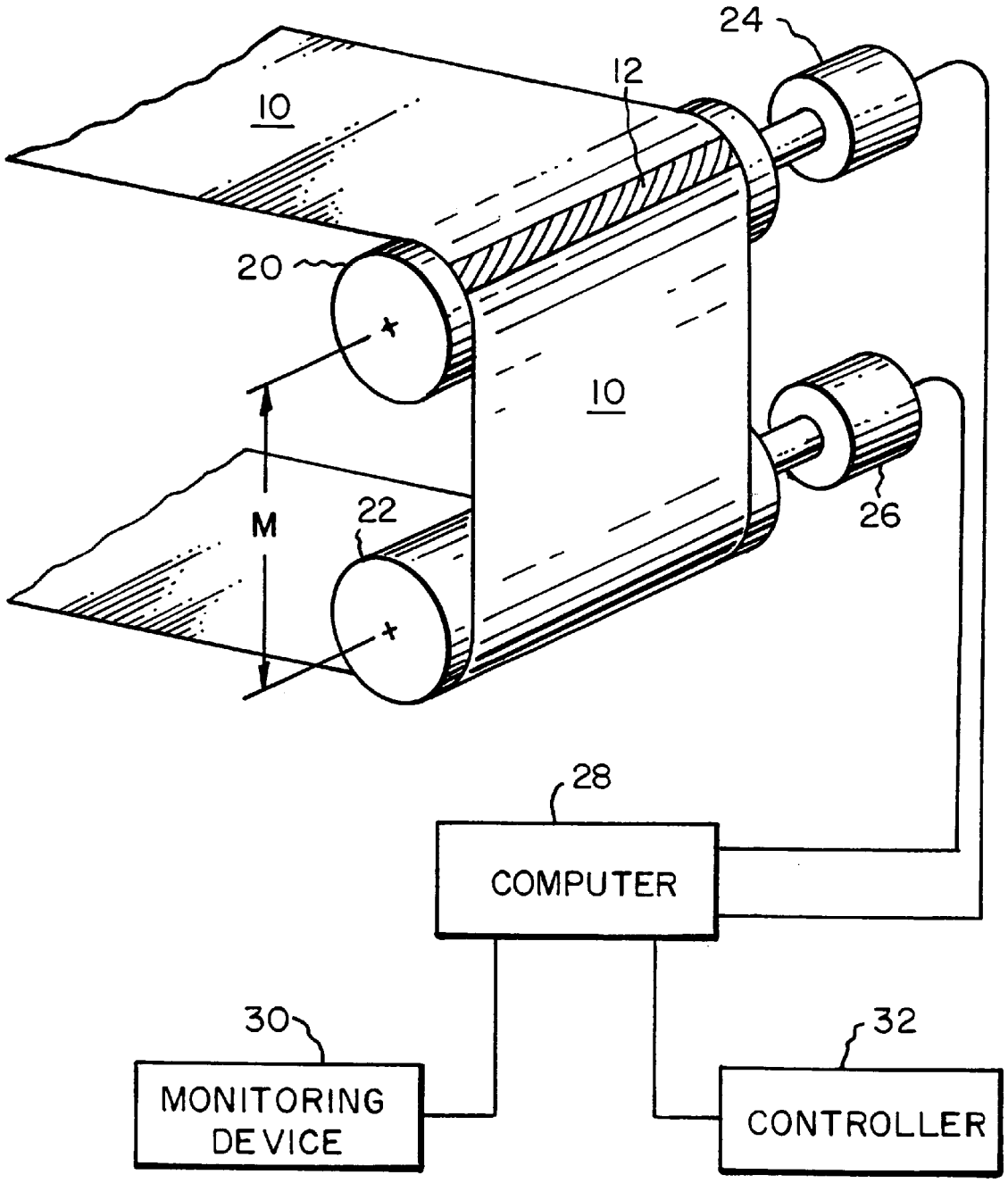
FIG. 4 shows the embodiment of FIG. 1 illustrating the splice disposed across the first roller.

Referring now to FIG. 4, splice 12 is disposed across first roller 20, while web material 10 is disposed across second roller 22; splice 12 is not disposed across second roller 22. As splice 12 is transported across first roller 20, speed $V_1$ of first roller will be less than speed $V_2$ of second roller 22. As such, as speeds $V_1$, $V_2$ are simultaneously determined by the computer 28 from the signals provided by the encoders, the difference in the speeds will be observed, thereby detecting the presence of splice 12 as a web speed disturbance. The presence of splice 12 is detected when the magnitude of the difference of speed values $V_1$, $V_2$ is greater than a predetermined value (the predetermined value being greater than zero since there is a difference between the speed values $V_1$, $V_2$). Alternatively, the presence of splice 12 is detected from the speed ratio R being different than 1.0.

Figure 5:
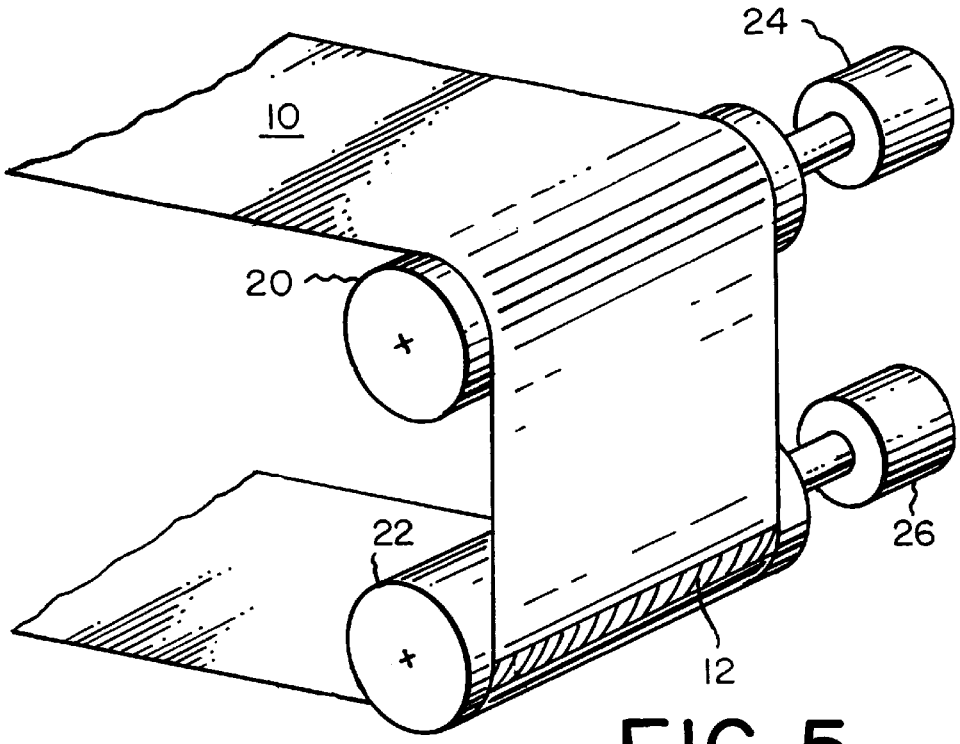
FIG. 5 shows the rollers of FIG. 4 illustrating the splice disposed across the second roller.

Referring now to FIG. 5, as web material 10 continues to be transported, splice 12 is disposed across second roller 22; splice 12 is not disposed across first roller 20. As such, speeds $V_1$, $V_2$ differ, and the presence of splice 12 is again detected.

Generally, a splice is detected when the speed ratio is different than 1.0. For example, Applicants have noted that at least about a 0.5 percent difference is indicative of a splice. As such, a speed ratio greater than about 1.005 or less than about 0.995 would be indicative of a presence of a splice.

Figure 6:
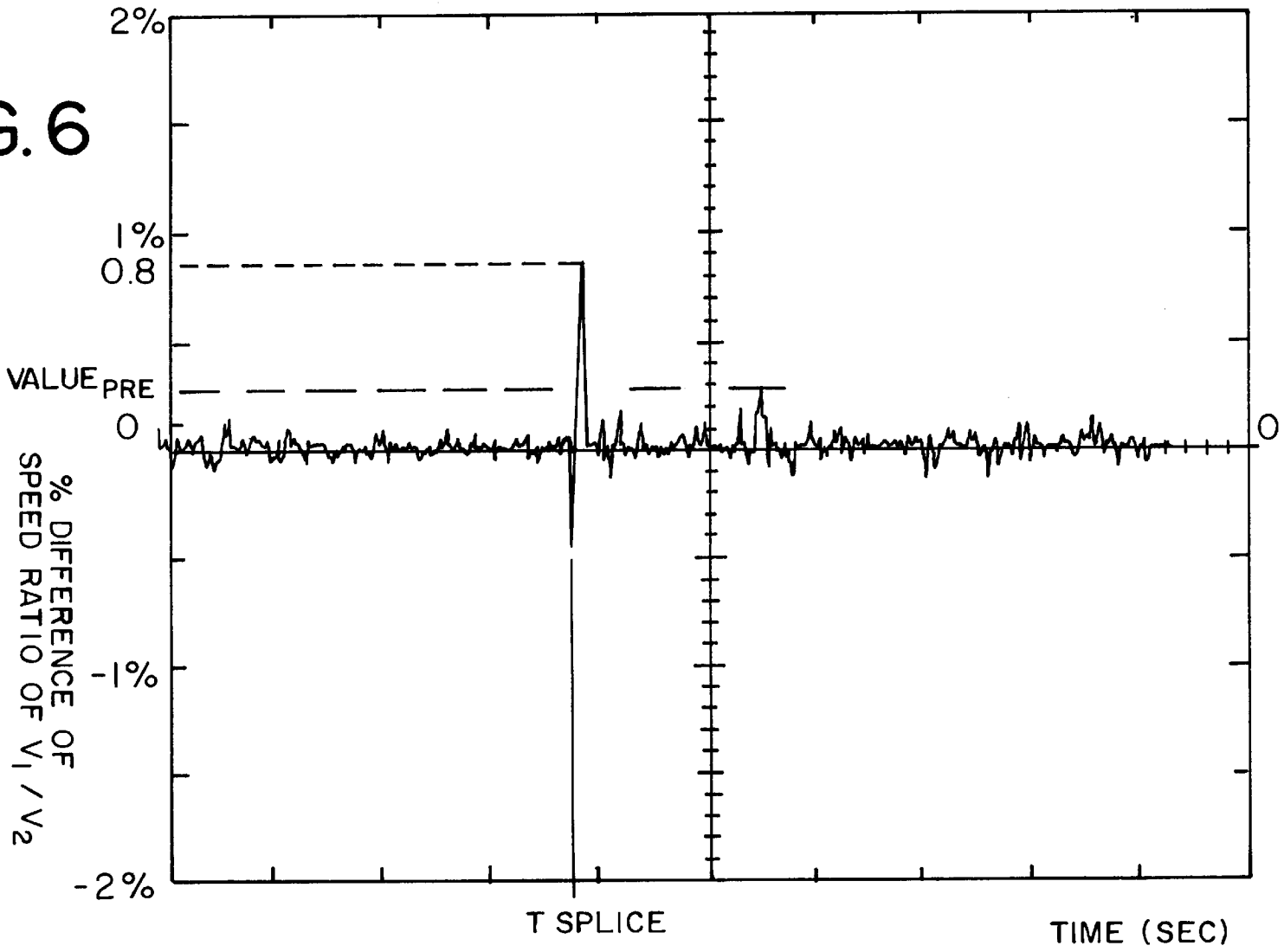
FIG. 6. shows a plot of time versus speed ratio for an example in accordance with the present invention.

FIG. 6 illustrates a plot of speed ratio R as a function of time for a specific example of web material including a butt splice, the web material traveling at about 700 feet/minute. The presence of splice 12 is detected when the magnitude of speed ratio R is greater than a predetermined value $Value_{pre}$ of 0.3 percent. As illustrated in FIG. 6, speed ratio R has a maximum value of about 0.8 percent, which is substantially different than predetermined value $Value_{pre}$ at time $T_{splice}$, thereby indicating the presence of a splice. Note that predetermined value $Value_{pre}$ has been selected to account for noise and other aberrations in the transport system.

Figure 7:
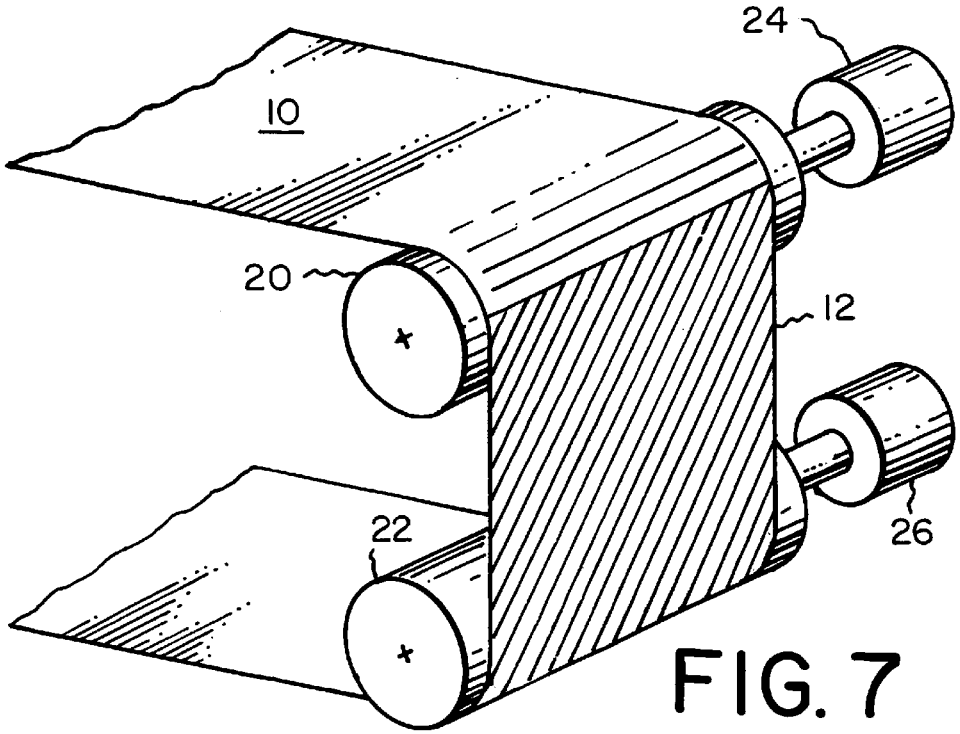
FIG. 7 shows the rollers of FIG. 4 illustrating the splice disposed across both the first and second rollers.

FIGS. 1–5 illustrate splice 12 as having a length L less than the distance M between first and second rollers 20, 22. The present invention can also be employed when length L is greater than distance M, as illustrated in FIG. 7, since at some moment of transport of the web material, splice 12 will not be disposed on first roller 20 but will be disposed on second roller 22.

Further, first and second rollers 20, 22 can be alternatively positioned, for example as shown in FIG. 8, so long as no nip is formed between first and second rollers 20, 22. However, it is preferable that first roller 20 and second roller 22 are in close proximity so as to reduce non-splice-induced speed differences.

Data and statistics for particular web material or transport parameters can be retained for immediate or post analysis.

The present invention provides advantages in that it can be employed independent of web thickness, or noise or vibration of the transport system. Further, the present invention is independent of web speed and material properties, such as dielectric constant or optical density.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

What is claimed is:

1. An apparatus for detecting a presence of a splice in a running length of web material, comprising:

a first encoder coupled to a first roller and producing a first encoder signal representative of a speed of the first roller as the length of web material is transported across the first roller;

a second encoder coupled to a second roller and producing a second encoder signal representative of a speed of the second roller as the length of web material is transported across the second roller, the second roller being spaced from the first roller, the first and second encoder signals being produced simultaneously; and a comparitor comparing the first and second encoder signals and producing a splice signal indicative of the presence of the splice in the length of web material when a difference between the first and second encoder signals is greater than a predetermined value.

2. An apparatus for detecting a presence of a splice in a running length of web material, comprising:

a first encoder coupled to a first roller and producing a first encoder signal representative of a speed of the first roller as the length of web material is transported across the first roller;

a second encoder coupled to a second roller and producing a second encoder signal representative of a speed of the second roller as the length of web material is transported across the second roller, the second roller being spaced from the first roller, the first and second encoder signals being produced simultaneously; and a comparitor producing a splice signal indicative of the presence of the splice in the length of web material when a ratio of the first encoder signal to the second encoder signal is different than 1.0.

3. The apparatus according to claim 2 wherein the comparitor produces the splice signal when the ratio of the first encoder signal to the second encoder signal is greater than 1.005.

4. The apparatus according to claim 2 wherein the comparitor produces the splice signal when the ratio of the first encoder signal to the second encoder signal is less than 0.995.

5. A method for detecting a presence of a splice in a running length of web material, comprising:

coupling a first encoder to a first roller;

coupling a second encoder to a second roller spaced from the first roller;

transporting the length of web material across the first and second rollers;

producing a first encoder signal representative of a speed of the first roller as the length of web material is transported across the first roller;

producing a second encoder signal representative of a speed of the second roller as the length of web material is transported across the second roller;

determining a ratio of the first encoder signal to the second encoder signal; and producing a splice signal indicative of the presence of the splice when the ratio differs from 1.0.

6. The method according to claim 5 wherein the splice signal is produced when the ratio is greater than 1.005.

7. The method according to claim 5 wherein the splice signal is produced when the ratio is less than 0.995.

8. A method for detecting a presence of a splice in a running length of web material, comprising:

coupling a first encoder to a first roller;

coupling a second encoder to a second roller spaced from the first roller;

transporting the length of web material across the first and second rollers;

producing a first encoder signal representative of a speed of the first roller as the length of web material is transported across the first roller;

producing a second encoder signal representative of a speed of the second roller as the length of web material is transported across the second roller; and producing a splice signal indicative of the presence of the splice in the length of web material when a difference between the first and second encoder signals is greater than a predetermined value.

* * * * *